United States Patent [19]

Walkup

[11] Patent Number: 4,714,442

[45] Date of Patent: Dec. 22, 1987

[54] LOW PROFILE LEAD SOCKET

[75] Inventor: William B. Walkup, Barrington, Mass.

[73] Assignee: Augat Inc., Mansfield, Mass.

[21] Appl. No.: 2,101

[22] Filed: Jan. 12, 1987

[51] Int. Cl.[4] ..... H01R 13/11

[52] U.S. Cl. ..... 439/844

[58] Field of Search ..... 339/258 R, 258 A, 258 P, 339/275 R, 275 T, 17 C

[56] References Cited

U.S. PATENT DOCUMENTS 3,510,831 5/1970 De Vito ..... 339/258 R

*Primary Examiner*—Joseph H. McGlynn

*Attorney, Agent, or Firm*—Weingarten, Schurgin, Gagnebin & Hayes

[57] ABSTRACT

A low-profile, conductive lead socket for insertion into a plated-through hole or conductive sleeve to receive a component lead inserted therein. The socket includes a cylindrical portion with upper and lower axial openings and a plurality of compliant fingers which extend from the lower opening to engage the inserted lead. The circumference of the socket frictionally engages the bore of the hole to establish electrical continuity between the lead and sleeve or hole plating. The fingers are angularly disposed in a helical arrangement about the central axis of the socket to shorten the socket profile without reducing finger compliance.

5 Claims, 6 Drawing Figures

LOW PROFILE LEAD SOCKET

FIELD OF THE INVENTION

This invention relates generally to electrical interconnection means and more particularly to electronic component lead sockets mountable in plated-through holes in printed circuit boards.

BACKGROUND OF THE INVENTION

Printed circuit boards usually include integral plated-through holes to receive the leads of electronic components mounted on the board. The lead socket was developed to allow a component to be plugged into the board and yet be removed at some later time for replacement or repair. The socket and hole are predesigned for a mutual fit whereby the socket, after being pressed into the hole, acts as an intermediate electrical conductor between the lead and hole plating. The socket bottom usually terminates in deformable fingers of uniform length which bend inward to meet the inserted lead. The socket at its outer circumference frictionally engages the plated bore of the hole; the lead, when inserted, similarly engages the finger tips of the socket. As there is no permanent bonding of the lead to the plating, as in a solder joint, the lead is removable. Pertinent examples of known lead sockets in the art may be found in U.S. Pat. Nos. 4,097,101, 4,175,810, and 4,186,990.

Because each finger is fixed at one end only, and must deform as it is engaged by the advancing edge of the lead tip, the finger can be modeled as a cantilever beam. The deflection y of the beam thus varies according to the cube of its length as defined by the equation:

$$y=Pl^3/3EI$$

where P=load, l=length, E=modulus of elasticity, and I=moment of inertia. Therefore, when all other variables are held constant, the length of a socket finger determines its relative compliance. Further, the length of the longest finger substantially establishes the height, or profile, of the socket.

It is advantageous to reduce the profile of the socket to reduce component height on densely-packed board arrays. However, a low-profile lead socket of conventional design would have a shorter, and thus less compliant, socket finger. Less-than-adequate compliance requires, among other things, a higher lead insertion force and stiffer leads which, in turn, would reduce the useable lifetime of a low-profile socket and would precipitate greater damage to the lead.

SUMMARY OF THE INVENTION

An improved lead socket having a shortened profile with no reduction in finger compliance is provided in the present invention. The lead socket is formed from a single stamped metal piece which is rolled into a tapered socket having a central bore with top and bottom openings and a plurality of fingers extending downward. Each finger is tilted at an angle to the central bore axis of the piece; when rolled into a socket shape, the fingers curl inward and around the axis in a helical configuration. The angular disposition of the fingers makes each finger at least as long, and thus as compliant, as a finger of a conventional socket. Any increase in finger length attained in the helical conrfiguration affords a three-fold increase in finger compliance. Thus, according to the present invention, the profile of the socket is reduced with no corresponding loss of compliance.

The diameter of the upper portion is sized to frictionally engage the inner walls of the plated-through hole so that the socket makes a secure mechanical and electrical contact with the surrounding conductor. The socket diameter may be slightly tapered to facilitate press-fitting the socket into a plated-through hole in a printed circuit board, or into a conductive sleeve or similarly-shaped conductive material. Because the fingers curl inward to impinge upon the incoming lead, they maintain compliant contact with the lead. The lead, after insertion into the socket, is retained by the fingers, yet the lead is removable at any time.

The reduction in the height of the lead socket not only allows the components to be more compactly mounted on the printed circuit board, but also facilitates the use of components having short leads. The low-profile socket also may be sized to mate with a variety of conductive sleeves, ferrules, and other lead receptables that have an interior cylindrical bore which typically requires soldering. Instead, the low-profile socket may be interposed between the lead and a lead receptacle so as to make the lead easily inserted, removed, and reinserted without soldering.

DESCRIPTION OF THE DRAWINGS

The invention will be more clearly understood from the following detailed description and drawings in which.

DETAILED DESCRIPTION OF THE INVENTION

Figure 1:
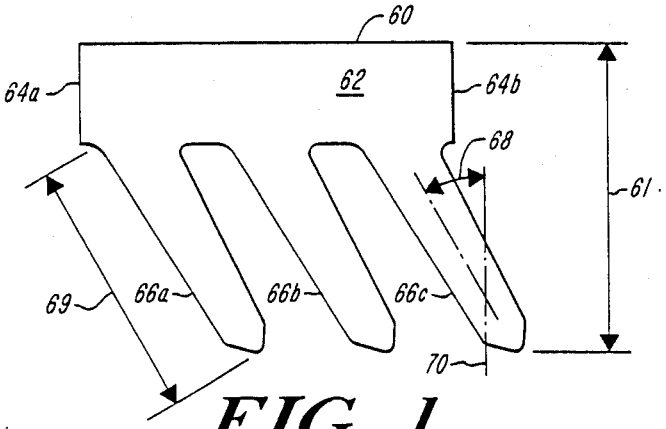
FIG. 1 is a plan view of a metal stamping for forming a lead socket according to the present invention.

With reference to FIG. 1 there is shown a stamped, conductive metal piece 60 having fingers **66*a*, 66*b* and 66*c* which extend from a roughly rectangular band 62 which includes joint edges 64*a* and 64*b*. The angle 68 with the vertical axis 70 is duplicated at each of the junctures of the fingers 66*a*, 66*b*, and 66*c* to the band 62. Each finger 66*a*, 66*b*, or 66*c* is angled from the vertical axis 70 so as to provide a sufficiently compliant finger length 69 in a reduced socket height 61**.

Figure 2:
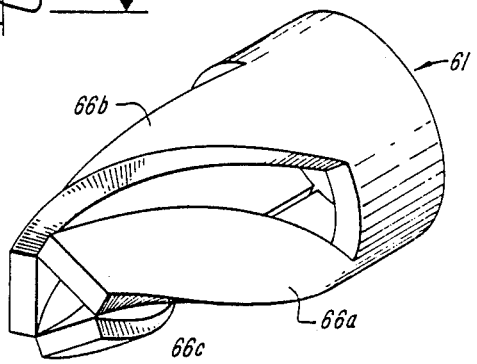
FIG. 2 is a pictorial view of a lead socket formed by rolling the stamping of FIG. 1 into a tapered shape.
Figure 3:
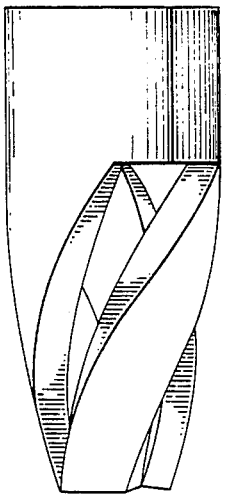
FIG. 3 is an elevation view of the lead socket of FIG. 2.
Figure 5:
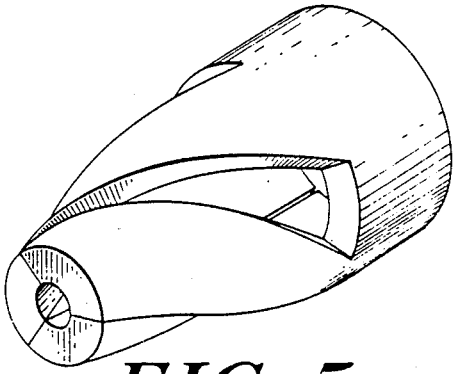
FIG. 5 is a pictorial view of an alternative embodiment.
Figure 4:
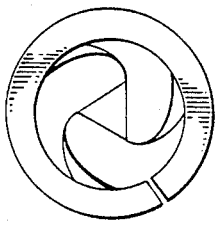
FIG. 4 is a bottom end view of the lead socket of FIG. 2.

FIGS. 2–4 depict the stamped piece 60 of FIG. 1 after being rolled into a tapered socket shape to form a socket 61. The piece 60 is rolled about the longitudinal axis with its joint edges **64*a* and 64*b* butted (overlapped, crimped, or otherwise joined) by machines and techniques well-known in the art. The socket fingers 66*a*, 66*b*, and 66*c* can be straight, as in FIG. 2, or can be curled about the axis 70 of the socket, as in FIG. 5**, to form a shape generally similar to that of a conical triple helix.

Figure 6:
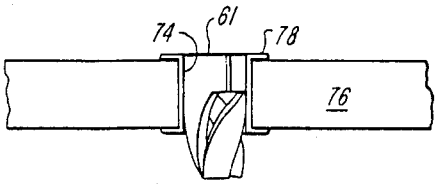
FIG. 6 is a sectional view of the lead socket inserted into a plated-through hole of a circuit board.

FIG. 6 shows a typical plated-through hole 78 formed in a printed circuit board 76. The plating typically includes a conductive solder coating on a conductive copper base. The socket 61 is inserted into the bore of the hole 78 from above and is press-fitted into tight contact with the inner wall 74; electrical continuity is thereby established between the socket and the solder-coated wall 74. The curled fingers *66a, 66b,* and *66c* engage the component lead as the lead is inserted into the socket. Electrical continuity is maintained due to the spring pressure of the fingers *66a, 66b,* and *66c;* in addition, the finger pressure exerts a retentive frictional force on the lead. Therefore, the lead is immobilized until it is withdrawn from the socket, whereupon it can be reinserted, replaced, or omitted.

The novel socket has a height which is less than the height of a conventional socket with straight tapered fingers without sacrifice of finger compliance. The socket can be formed with other than the three fingers of the illustrated embodiments. The three finger configuration is preferable for use with rectangular cross-section leads since the four corners of the rectangular lead are more readily engaged by the three fingers than a four finger socket. The socket can also be used in a conductive sleeve rather than directly in a circuit board plated hole.

The invention is not to be limited by what has been particularly shown and described, except as indicated in the appended claims.

What is claimed is:

1. A lead socket for insertion into a plated-through hole in a printed circuit board to receive a lead inserted therein comprising:

a conductive, generally cylindrical portion having a longitudinal axis and upper and lower openings;

a plurality of conductive, compliant fingers each extended from the cylindrical portion and angled about the longitudinal axis in a generally conical helix configuration.

2. The lead socket of claim 1 wherein the fingers are arranged so that lateral edges of adjacent fingers are substantially confronting at the tips of the fingers.

3. The lead socket of claim 1 wherein the fingers are arranged so that lateral sides of adjacent fingers are substantially parallel at the tips of the fingers.

4. A lead socket for insertion into a plated-through hole in a printed circuit board to receive a lead inserted therein comprising:

a conductive, generally cylindrical portion having a longitudinal axis and axially disposed upper and lower openings frictionally engaging the plated-through hole; and a plurality of conductive, compliant fingers frictionally engaging and electrically contacting the component lead and extending downward from the cylindrical portion and normally inward in a generally conical helix oriented to reduce the height of the socket without corresponding reduction in finger length.

5. A lead socket for insertion into a plated-through hole in a printed circuit board to receive a lead inserted therein comprising:

a conductive, generally cylindrical portion having upper and lower axial openings and an exterior side frictionally engaging and establishing electrical continuity with a contact surface of the plated-through hole; and a plurality of compliant fingers, each of which extends helically downward and normally inward from the lower axial opening in reduction of the overall height of the socket without a corresponding reduction in finger length, and each of which firctionally engages and electrically contacts the component lead to establish electrical continuity from the lead through the finger and the cylindrical portion to the contact surface.

* * * * *